US012077401B2

(12) United States Patent
Suzuki

(10) Patent No.: US 12,077,401 B2
(45) Date of Patent: Sep. 3, 2024

(54) POST-PROCESSING APPARATUS

(71) Applicant: FUJIFILM Business Innovation Corp., Tokyo (JP)

(72) Inventor: Masatoshi Suzuki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 35 days.

(21) Appl. No.: 17/383,420

(22) Filed: Jul. 22, 2021

(65) Prior Publication Data

US 2022/0258998 A1 Aug. 18, 2022

(30) Foreign Application Priority Data

Feb. 17, 2021 (JP) ..... 2021-023640

(51) Int. Cl.
*B65H 29/58* (2006.01)
*B65H 29/52* (2006.01)

(52) U.S. Cl.
CPC ..... *B65H 29/58* (2013.01); *B65H 29/52* (2013.01)

(58) Field of Classification Search
CPC ..... B65H 29/52; B65H 29/58
USPC ..... 271/296, 297, 301, 303
See application file for complete search history.

(56) References Cited

U.S. PATENT DOCUMENTS 2,815,949 A * 12/1957 Faeber ..... B65H 29/60 271/302
6,186,496 B1 * 2/2001 Marasco ..... B65H 29/58 271/305
7,578,504 B2 * 8/2009 Tsai ..... H04N 1/0058 271/304
8,276,913 B2 * 10/2012 Bianco ..... B65H 85/00 271/301
2002/0135124 A1 * 9/2002 Suzuki ..... B65H 29/70 271/188
2003/0234487 A1 * 12/2003 Tamura ..... B65H 29/58 271/303
2005/0082747 A1 * 4/2005 Tamura ..... B65H 29/58 271/184
2010/0038848 A1 * 2/2010 Tratar ..... B65H 29/58 271/303
2014/0048385 A1 * 2/2014 Agier ..... B65G 47/46 198/368
2015/0344255 A1 * 12/2015 Moon ..... B65H 29/58 271/9.13

(Continued)

FOREIGN PATENT DOCUMENTS

JP 2018034972 3/2018

*Primary Examiner* — Thomas A Morrison
(74) *Attorney, Agent, or Firm* — JCIPRNET

(57) ABSTRACT

A post-processing apparatus includes: a transport passage on which a sheet that has been sequentially transported from an upstream side is transported; a first transport path on which the sheet that has been transported from the transport passage is transported in a first direction; a second transport path on which the sheet that has been transported from the transport passage is transported in a second direction; a third transport path on which the sheet that has been transported from the transport passage is transported in a third direction; and a guide mechanism that guides the sheet that has been transported from the transport passage, to any of the first, second, and third transport paths, in which the guide mechanism is configured by one switching mechanism.

6 Claims, 13 Drawing Sheets

(56) References Cited

U.S. PATENT DOCUMENTS

| | | | | |
|---|---|---|---|---|
| 2016/0280495 | A1* | 9/2016 | Kodama | B65H 3/66 |
| 2020/0102171 | A1* | 4/2020 | Ishifune | B65H 5/06 |

* cited by examiner

SWITCHING MECHANISM OF GATE MEMBERS 31 AND 32

POST-PROCESSING APPARATUS

CROSS-REFERENCE TO RELATED APPLICATIONS

This application is based on and claims priority under 35 USC 119 from Japanese Patent Application No. 2021-023640 filed Feb. 17, 2021.

BACKGROUND

(i) Technical Field

The present invention relates to a post-processing apparatus.

(ii) Related Art

JP2018-034972A discloses a post-processing apparatus including a gate member that is made of a resin having a ribbed structure and is configured to have, at the tip part, a plane portion that is pressed by a printing sheet that has been transported and comes into contact with a transport passage constituent member, in which the plane portion of the gate member is pressed downward by being brought into contact with the printing sheet that has been transported from upstream to pass the printing sheet, and while the printing sheet is being passed after the plane portion is pressed downward once, plural protrusions farther away from a fulcrum than the plane portion come into contact with the printing sheet to hold the printing sheet in a passable state.

SUMMARY

In a post-processing apparatus that performs various post-processes such as a folding process, a stapling process, and a booklet making process on a sheet on which an image is formed, a guide mechanism for guiding a sheet that has been transported, in various transport directions is used. As such a guide mechanism, a gate member for switching the transport directions is provided, and by driving the position of the gate member by a solenoid or the like, the sheet that has been transported can be switched between two transport directions.

However, in a case where the sheet that has been transported is switched between three transport directions, such gate members are arranged at two points, and two driving mechanisms for respectively driving the two gate members are necessary. Furthermore, providing the two gate members at different places needs different installation places and causes an increase in the size of the apparatus.

Aspects of non-limiting embodiments of the present disclosure relate to a post-processing apparatus that is capable of switching a sheet that has been transported between three transport directions by providing only one switching mechanism for switching transport directions of a sheet.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a post-processing apparatus including:

a transport passage on which a sheet that has been sequentially transported from an upstream side is transported;

a first transport path on which the sheet that has been transported from the transport passage is transported in a first direction;

a second transport path on which the sheet that has been transported from the transport passage is transported in a second direction;

a third transport path on which the sheet that has been transported from the transport passage is transported in a third direction; and a guide mechanism that guides the sheet that has been transported from the transport passage, to any of the first, second, and third transport paths, in which the guide mechanism is configured by one switching mechanism.

BRIEF DESCRIPTION OF THE DRAWINGS

Exemplary embodiment(s) of the present invention will be described in detail based on the following figures, wherein.

DETAILED DESCRIPTION

Next, an exemplary embodiment of the present invention will be described in detail with reference to the drawings.

Figure 1:
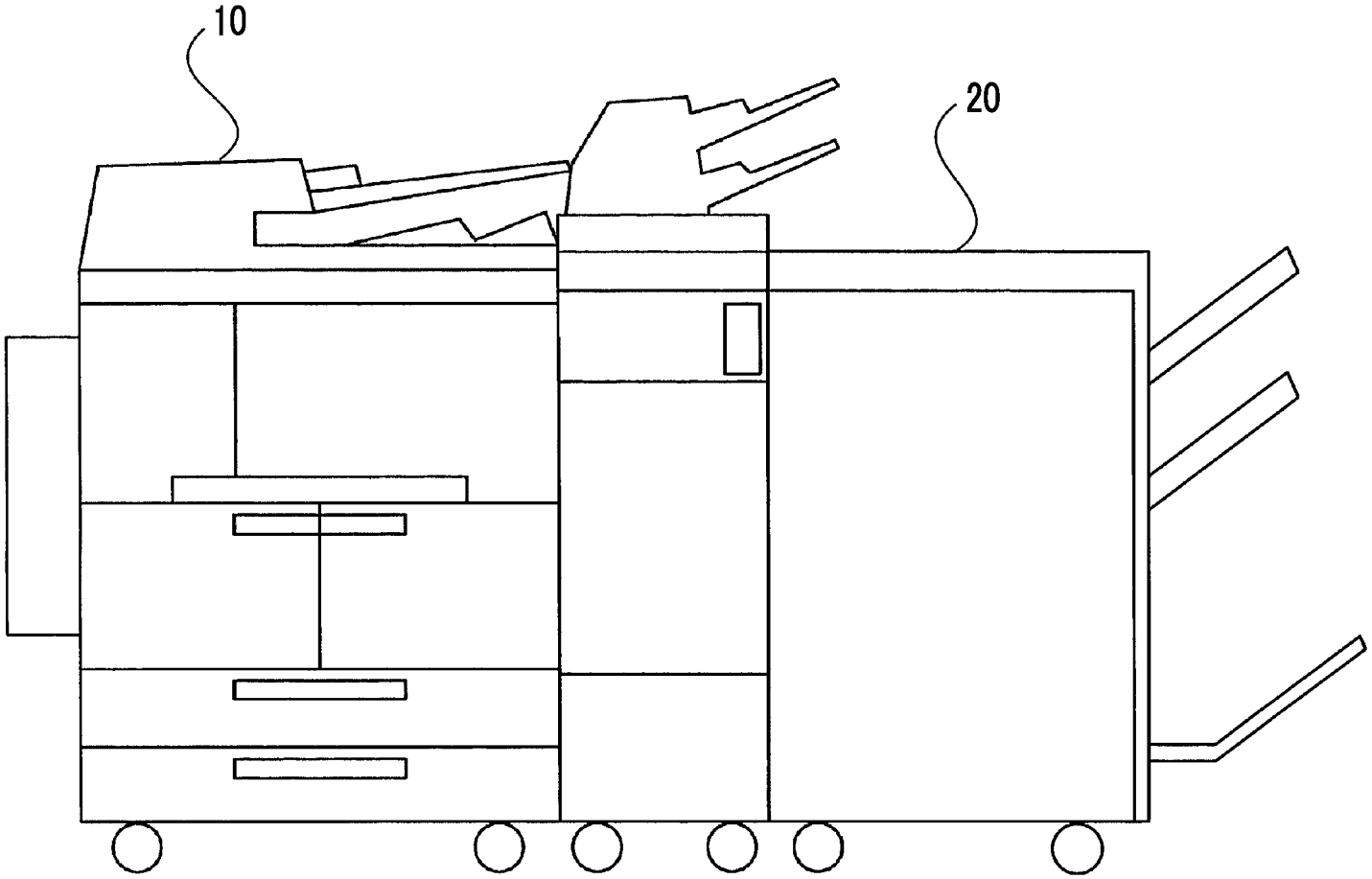
FIG. 1 is a diagram showing an image forming system of an exemplary embodiment of the present invention.

FIG. 1 is a diagram showing an image forming system of an exemplary embodiment of the present invention.

As shown in FIG. 1, the image forming system of the present exemplary embodiment includes an image forming apparatus 10 and a post-processing apparatus 20.

The image forming apparatus 10 is an electrophotographic printer, and prints an image on a recording medium such as a printing sheet through steps such as charging, exposure, development, transfer, and fixing in response to an operation from an operator. The recording medium on which the image is formed is sent to the post-processing apparatus 20.

The post-processing apparatus 20 has a plurality of post-processing units, and performs post-processes on a recording medium such as a printing sheet on which an image is formed by the image forming apparatus 10.

Here, the post-processes are processes applied to a printing sheet or the like after an image is formed, and include, for example, a stapling process, a punching process, a bookbinding process, and a folding process.

Next, an overview of the structure of the post-processing apparatus 20 will be described with reference to FIG. 2.

Figure 2:
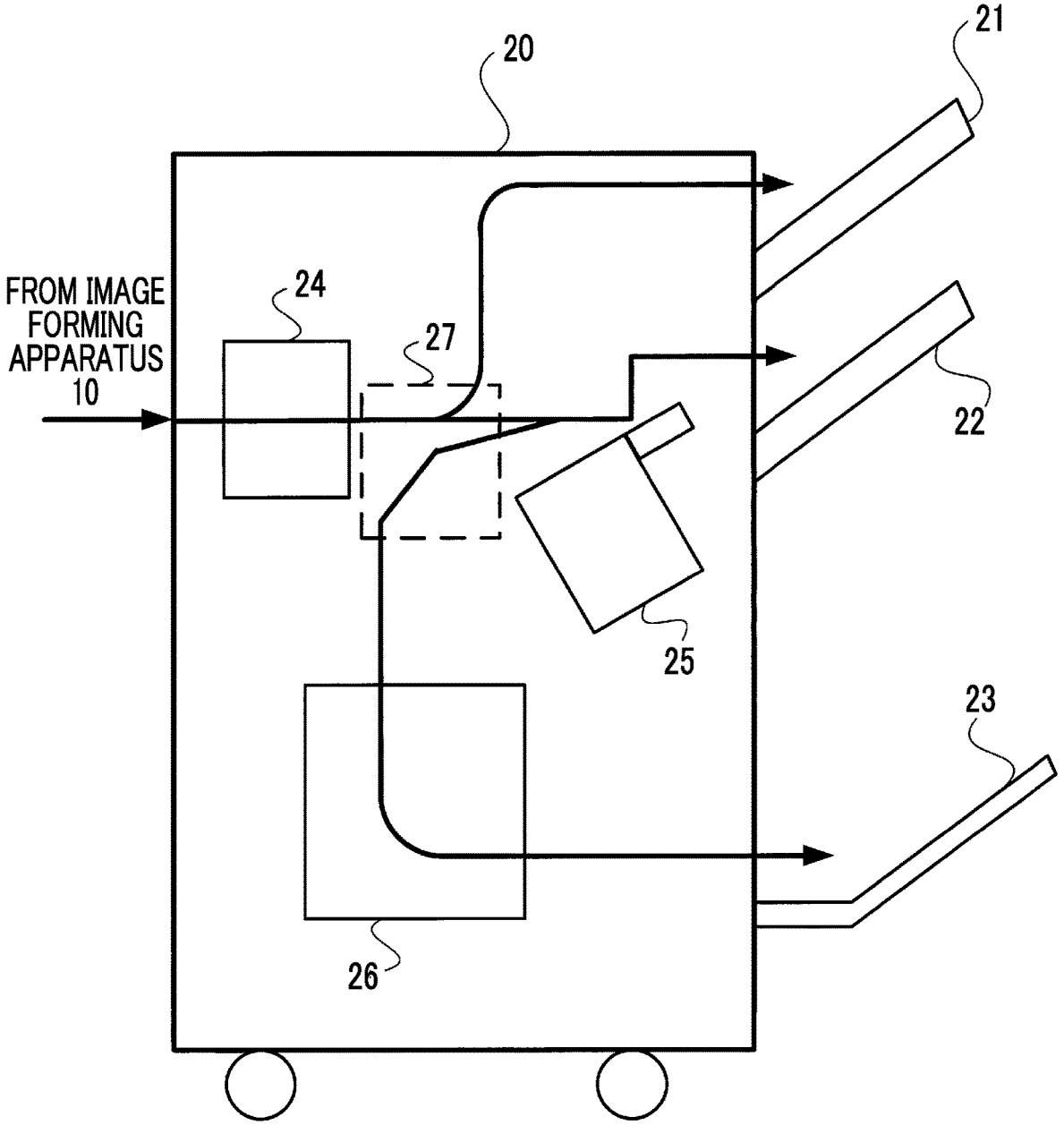
FIG. 2 is a diagram for describing an overview of the structure of a post-processing apparatus 20.

As shown in FIG. 2, the post-processing apparatus 20 has a transport passage on which a sheet that has been sequentially transported from the image forming apparatus 10 on the upstream side is transported, and includes a perforating unit 24 that performs a punching process on the sheets that have been transported from the transport passage, an edge binding unit 25 that performs a stapling process after the sheets that have been transported are made into a bundle of plural sheets, and a middle binding unit 26 that performs a bookbinding process after the sheets that have been transported are made into a bundle of plural sheets.

Furthermore, the post-processing apparatus 20 includes, as discharge destinations for discharging the sheets after being subjected to the post-processes by the perforating unit 24, the edge binding unit 25, and the middle binding unit 26, three discharge destinations including a discharge tray 21, a finisher tray 22, and a bookbinding tray 23.

Since the post-processing apparatus 20 has such a configuration, the inside of the post-processing apparatus 20 is provided with a first transport path on which the sheet that has been transported from the transport passage is transported in a direction toward the discharge tray 21, which is a first direction, a second transport path on which the sheet that has been transported from the transport passage is transported in a direction toward the edge binding unit 25 and the finisher tray 22, which is a second direction, and a third transport path on which the sheet that has been transported from the transport passage is transported in a direction toward the middle binding unit 26, which is a third direction.

For example, in a case where the sheet that has been transported is subjected only to the punching process by the perforating unit 24, or in a case where no post-process is performed, the sheet is discharged to the discharge tray 21 via the first transport path. The sheet subjected to the stapling process in the edge binding unit 25 after passing through the perforating unit 24 is discharged to the finisher tray 22 via the second transport path. Furthermore, the sheet subjected to the bookbinding process in the middle binding unit 26 after passing through the perforating unit 24 is discharged to the bookbinding tray 23 via the third transport path.

Since the post-processing apparatus 20 is provided with three transport paths as described above, as a guide mechanism that guides the sheet that has been transported from the transport passage to any of the first, second, and third transport paths, one switching mechanism 27 is provided.

Figure 3:
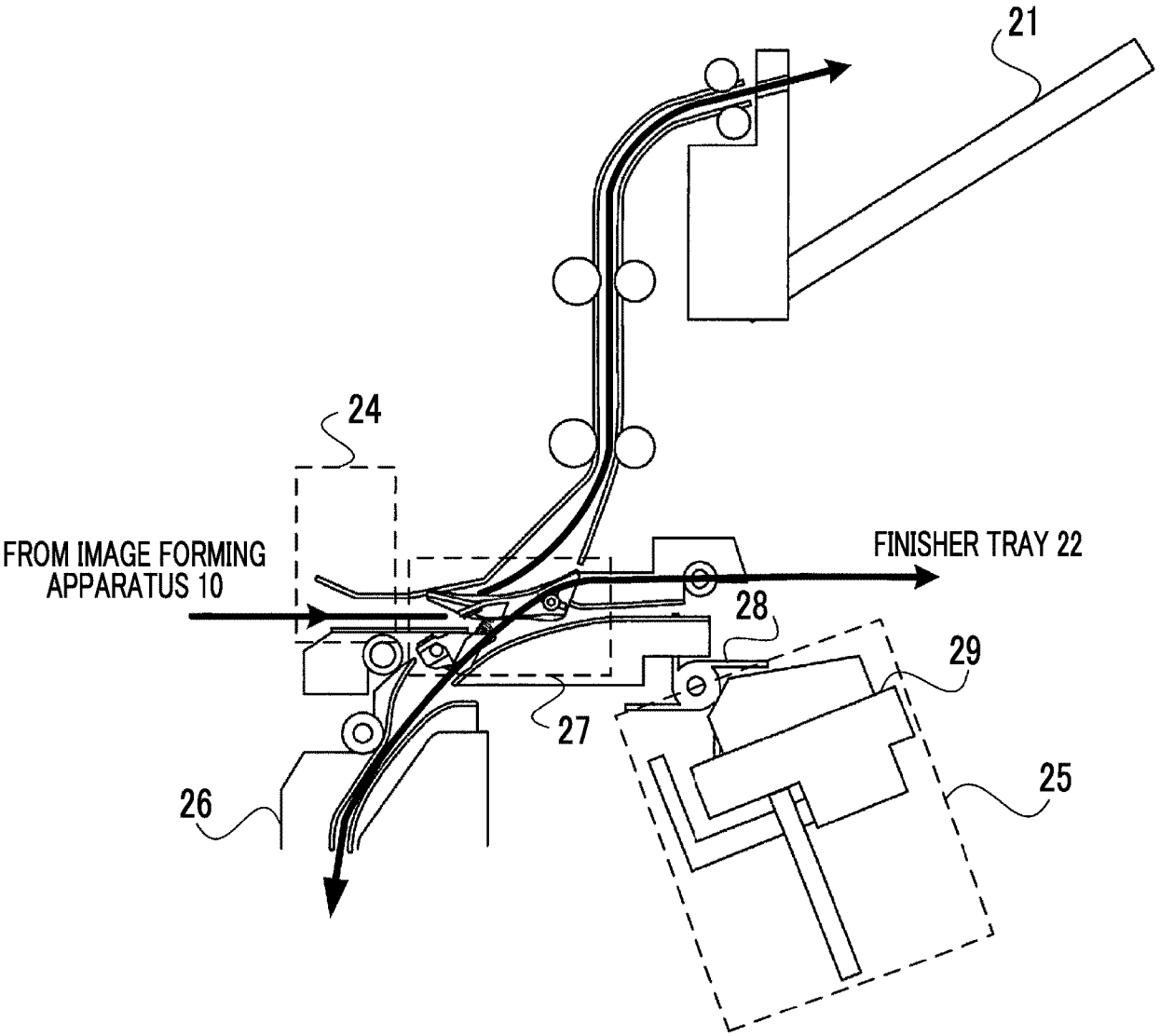
FIG. 3 is an enlarged view of the periphery of a switching mechanism 27.

Next, an enlarged view around the switching mechanism 27 is shown in FIG. 3.

The switching mechanism 27 is provided on the transport passage on which the sheet has been sequentially transported from the image forming apparatus 10 on the upstream side, and switches the transport direction of the sheets that have been transported from the image forming apparatus 10 to any of the direction toward the discharge tray 21, the direction toward the edge binding unit 25 and the finisher tray 22, and the direction toward the middle binding unit 26.

The edge binding unit 25 is provided with a compile tray 29 that causes the sheets that have been transported to overlap and form a bundle of the sheets, and the sheets that have been transported via the switching mechanism 27 is transported to the compile tray 29 by a transport roll 28. The transport roll 28 functions as a transport unit that transports the sheet on the transport passage.

In a case where the sheet is to be transported in the direction toward the middle binding unit 26, the transport direction of the transport roll 28 is reversed after the sheet is transported in the direction toward the compile tray 29 from the switching mechanism 27, so that the sheet is transported in the direction toward the middle binding unit 26.

Figure 4:
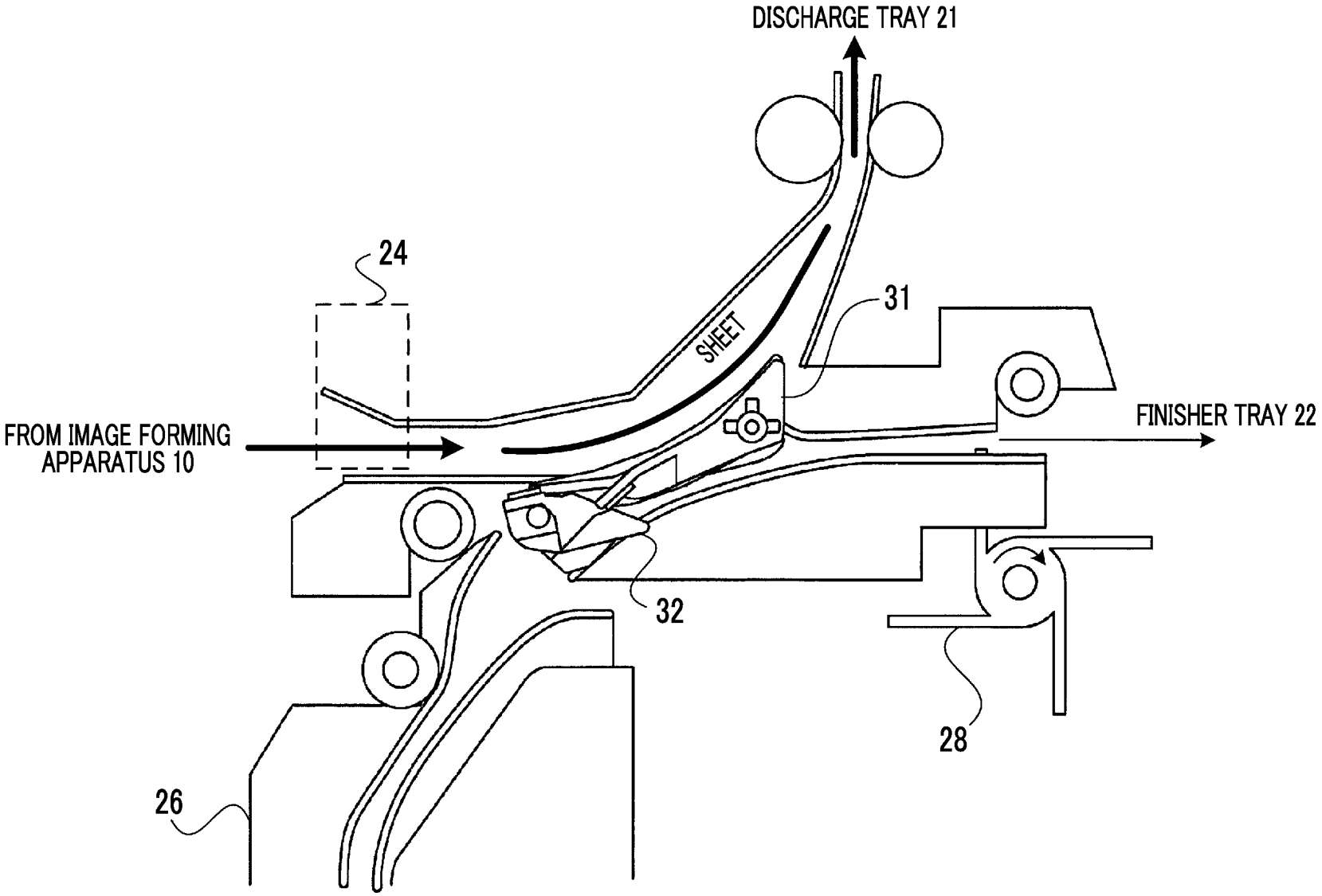
FIG. 4 is an enlarged view of the switching mechanism 27.

An enlarged view of the switching mechanism 27 is shown in FIG. 4. Referring to FIG. 4, the switching mechanism 27 has a gate member 31, a driving member (not shown) that operates the gate member 31, and a gate member 32 that operates in conjunction with the gate member 31.

The gate member 32 has a plane portion that is biased by an elastic member such as a spring in a direction in which the gate member 31 is provided, and is pressed downward by being brought into contact with the sheet that has been transported from the transport passage to pass the sheet.

The biasing force that biases the gate member 32 in the direction in which the gate member 31 is provided is set to be less than or equal to a force at which the gate member 32 is pressed downward by a transportation pressure in a case where the sheet that has been transported from the transport passage comes into contact with the plane portion and be more than or equal to a force at which the gate member 32 can be lifted to a position where the gate member 32 comes into contact with the gate member 31.

The gate member 32 is provided with a contact surface for contact with the gate member 31. In addition, a contact surface of the gate member 31 for contact with the gate member 32 is provided with a urethane cushion material for silencing the sound in a case of coming into contact with the contact surface of the gate member 32 as a silencing member. The details of the structures of the gate members 31 and 32 will be described later.

Figure 5:
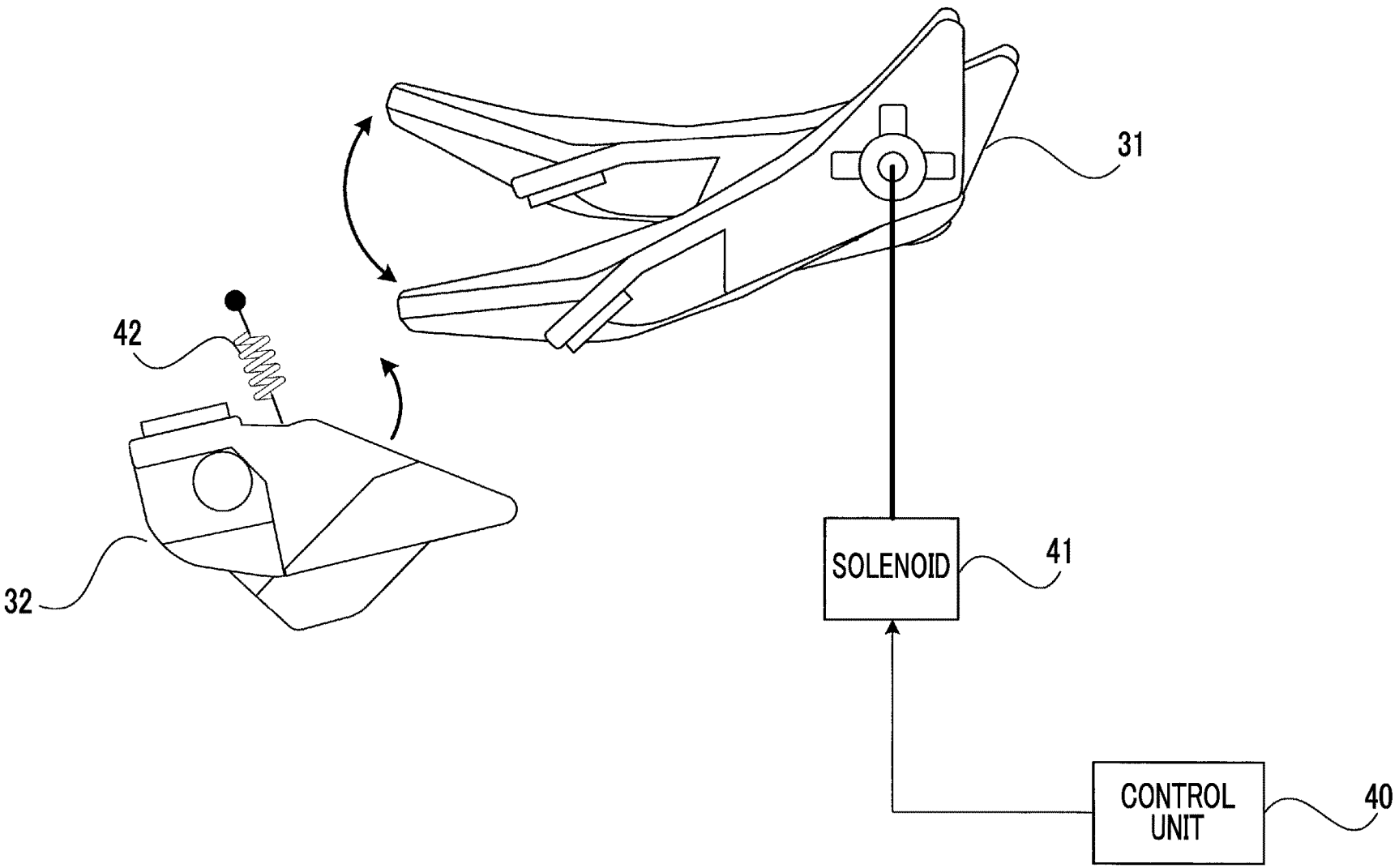
FIG. 5 is a diagram for describing a switching mechanism of gate members 31 and 32.

First, the switching mechanism of the gate members 31 and 32 will be described with reference to FIG. 5.

The gate member 31 is rotatably installed about a certain rotation axis. The gate member 31 is connected to a solenoid 41 by a link mechanism, and is configured to switch between an upper position and a lower position in a vertical direction according to an on/off state of the solenoid 41. The solenoid 41 is controlled by a control unit 40, and the control unit 40 controls the solenoid 41 to be turned on or off depending on the method of transporting the sheet.

The gate member 32 is also rotatably installed about a certain rotation axis. The gate member 32 is biased upward by a spring 42 in the vertical direction, that is, toward the side where the gate member 31 is provided.

Therefore, the gate member 32 is configured to operate in conjunction with the gate member 31. In a state in which the gate member 31 is switched to the upper position, the gate member 32 rotates upward to a position where the gate member 32 comes into contact with the gate member 31, and by switching the gate member 31 to the lower position, the gate member 32 rotates downward by being pressed downward by the gate member 31.

The switching mechanism 27 has such a configuration, and switches the sheet that has been transported from the image forming apparatus 10 between the three transport directions as follows.

First, an operation in a case where the switching mechanism 27 switches the sheet in the direction toward the discharge tray 21 will be described with reference to FIG. 4.

In a case of switching the sheet to the direction toward the discharge tray 21, as shown in FIG. 4, the control unit 40 switches the state of the solenoid 41 to move the gate member 31 to the lower position. Therefore, the gate member 32 is pressed downward by the gate member 31 and rotates downward.

As a result, as shown in FIG. 4, the sheet that has been transported from the image forming apparatus 10 is guided by the upper surface of the gate member 31 such that the transport direction is switched to the direction toward the discharge tray 21.

Next, an operation in a case where the switching mechanism 27 switches the sheet to the direction toward the finisher tray 22 will be described with reference to FIG. 6.

Figure 6:
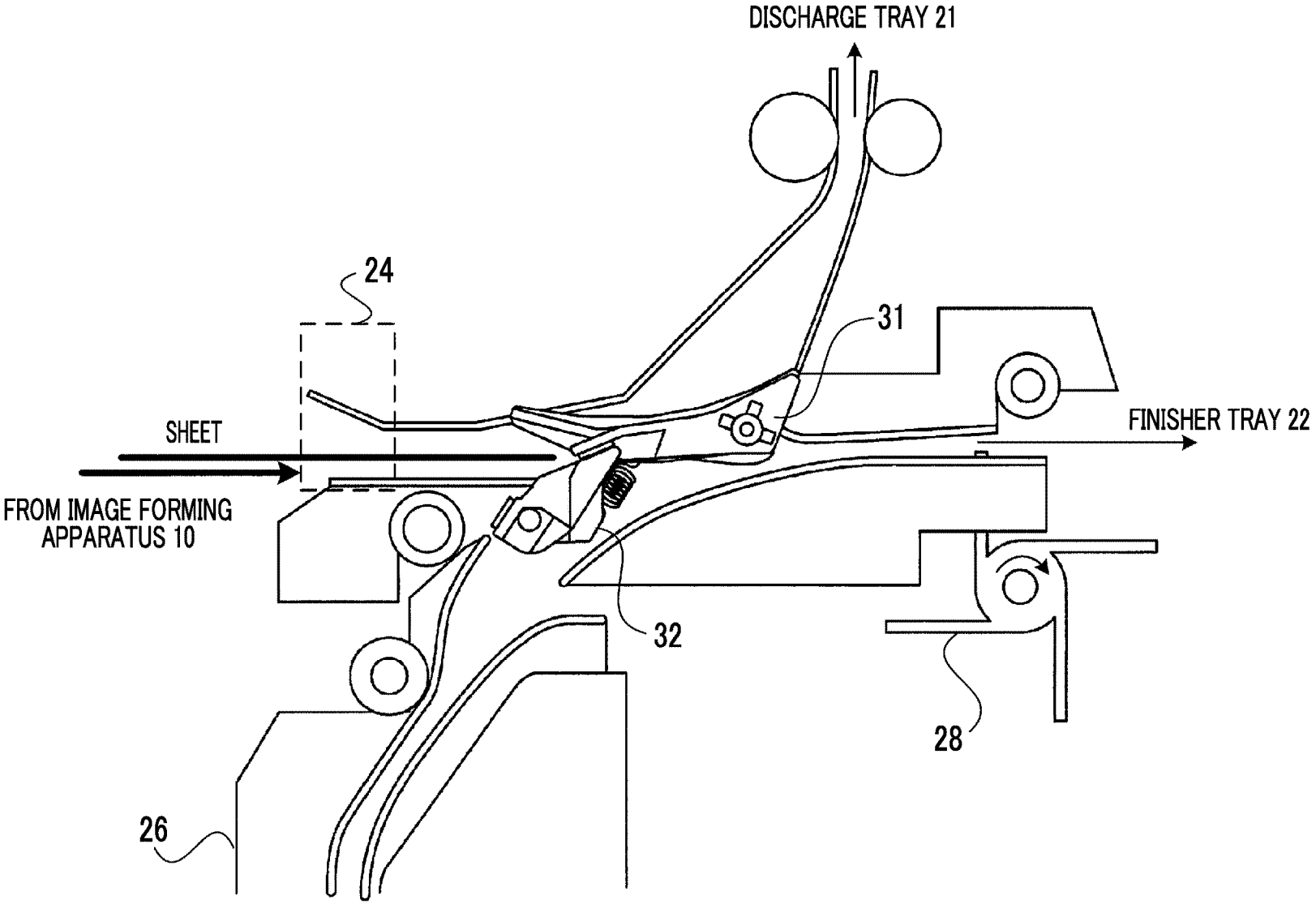
FIG. 6 is a diagram for describing an operation in a case where the switching mechanism 27 switches a sheet to a direction toward a finisher tray 22.

In a case of switching the sheet to the direction toward the finisher tray 22, the control unit 40 switches the state of the solenoid 41 to move the gate member 31 to the upper position as shown in FIG. 6. Therefore, the gate member 32 also moves in conjunction with the gate member 31 and rotates upward.

Figure 7:
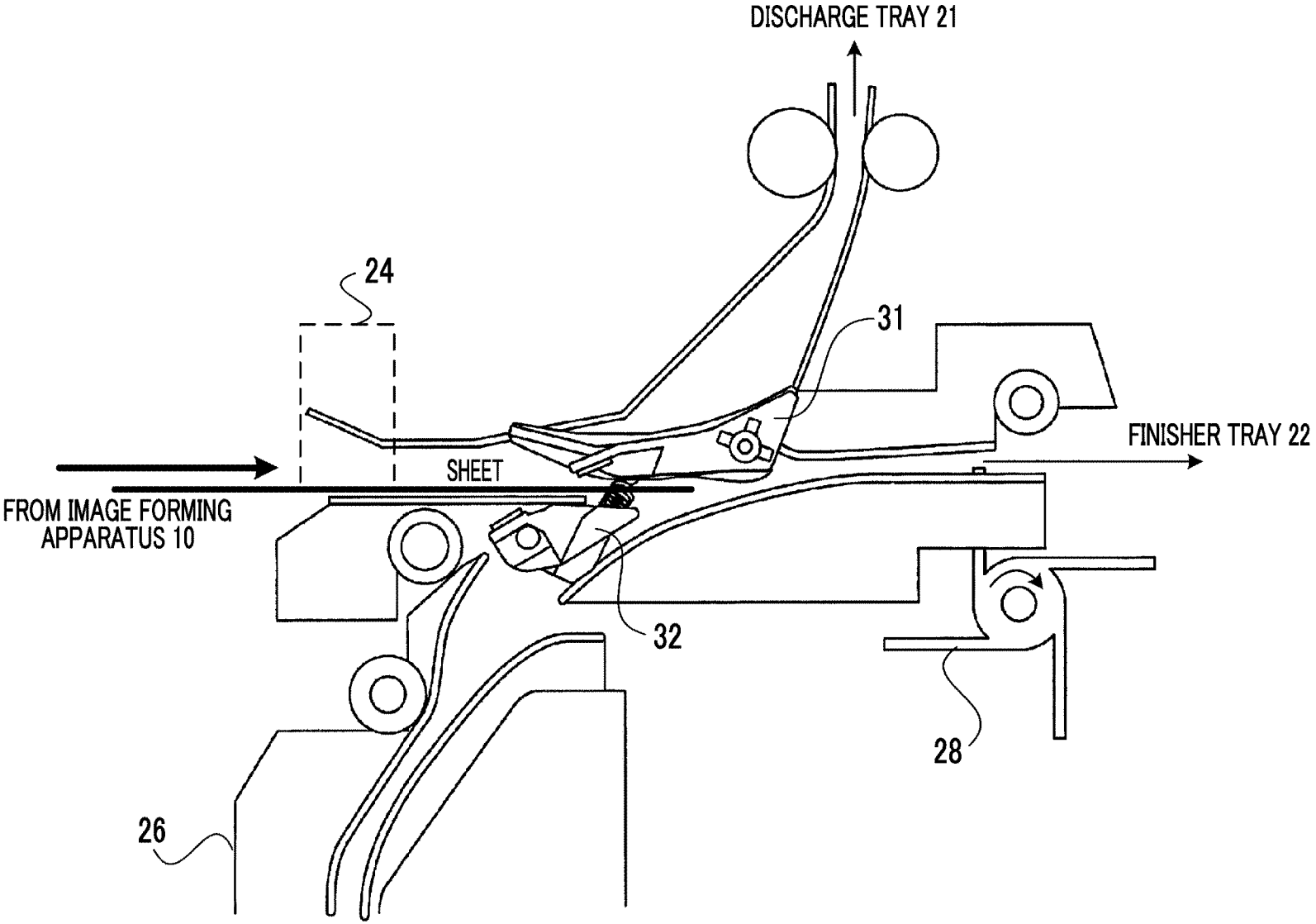
FIG. 7 is a diagram for describing an operation in a case where the gate member 32 passes the sheet that has been transported from an image forming apparatus 10.

As a result, as shown in FIG. 6, the transport passage of the sheet that has been transported from the image forming apparatus 10 is in a closed state. However, in a case where the sheet has been transported from the image forming apparatus 10, as shown in FIG. 7, a downward force is applied to the gate member 32 due to the transportation pressure of the sheet that has been transported. Therefore, the gate member 32 rotates downward due to the transportation pressure of the sheet and the own weight thereof. As a result, the sheet that has been transported from the image forming apparatus 10 passes through the gate member 32 and is transported in the direction toward the finisher tray 22.

Figure 8:
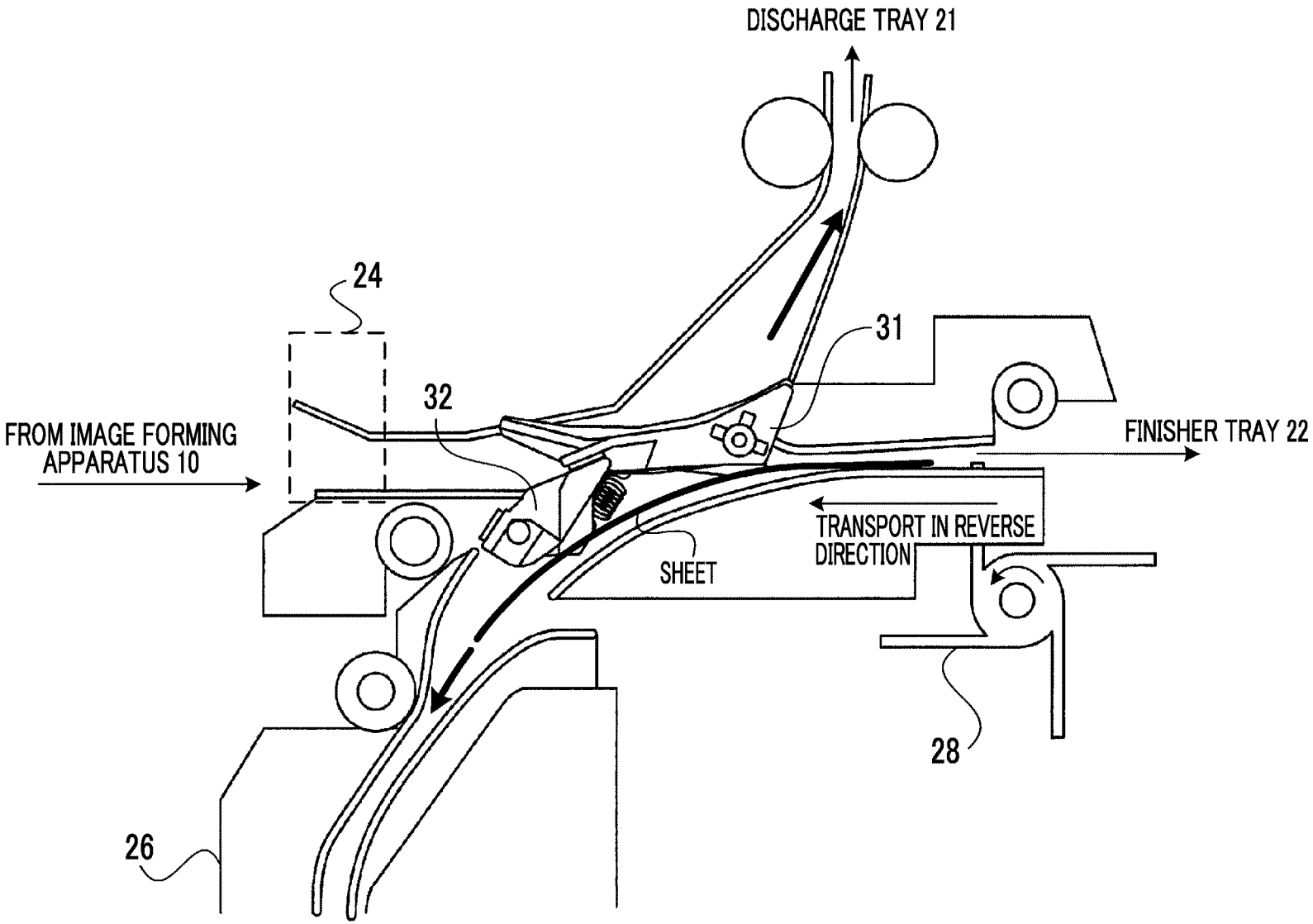
FIG. 8 is a diagram for describing an operation in a case where the switching mechanism 27 switches the sheet in a direction toward a middle binding unit 26.

Last, an operation in a case where the switching mechanism 27 switches the sheet to the direction toward the middle binding unit 26 will be described with reference to FIG. 8.

After the sheet has passed through the gate member 32 in the state shown in FIG. 7, the control unit 40 rotates the transport roll 28 in the reverse direction. Then, the sheet that has passed through the gate member 32 is transported in the direction toward the gate member 32 and abuts on the gate member 32. However, since the shape of the gate member 32 seen from the transport roll 28 side is such a shape that guides the sheet in a downward direction, the sheet that has been transported in the reverse direction does not pass through the gate member 32 and is guided in the downward direction. As a result, the sheet that has been transported in the reverse direction by the transport roll 28 is transported in the direction toward the middle binding unit 26.

Next, the detailed configurations of the gate members 31 and 32 described above will be described.

Figure 9:
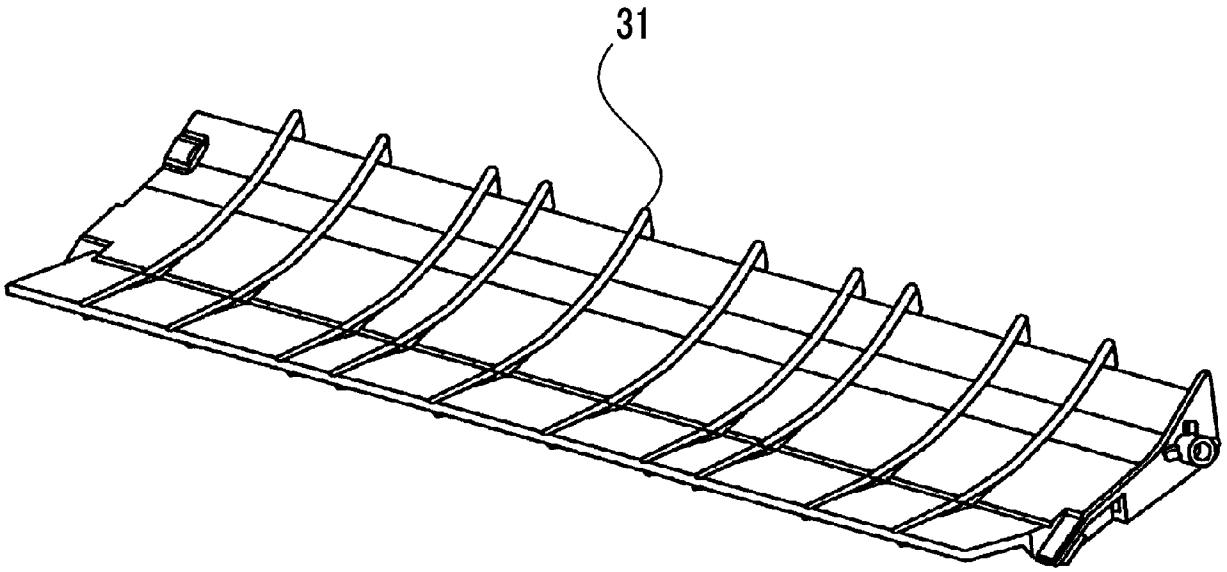
FIG. 9 is a perspective view of the gate member 31.
Figure 10:
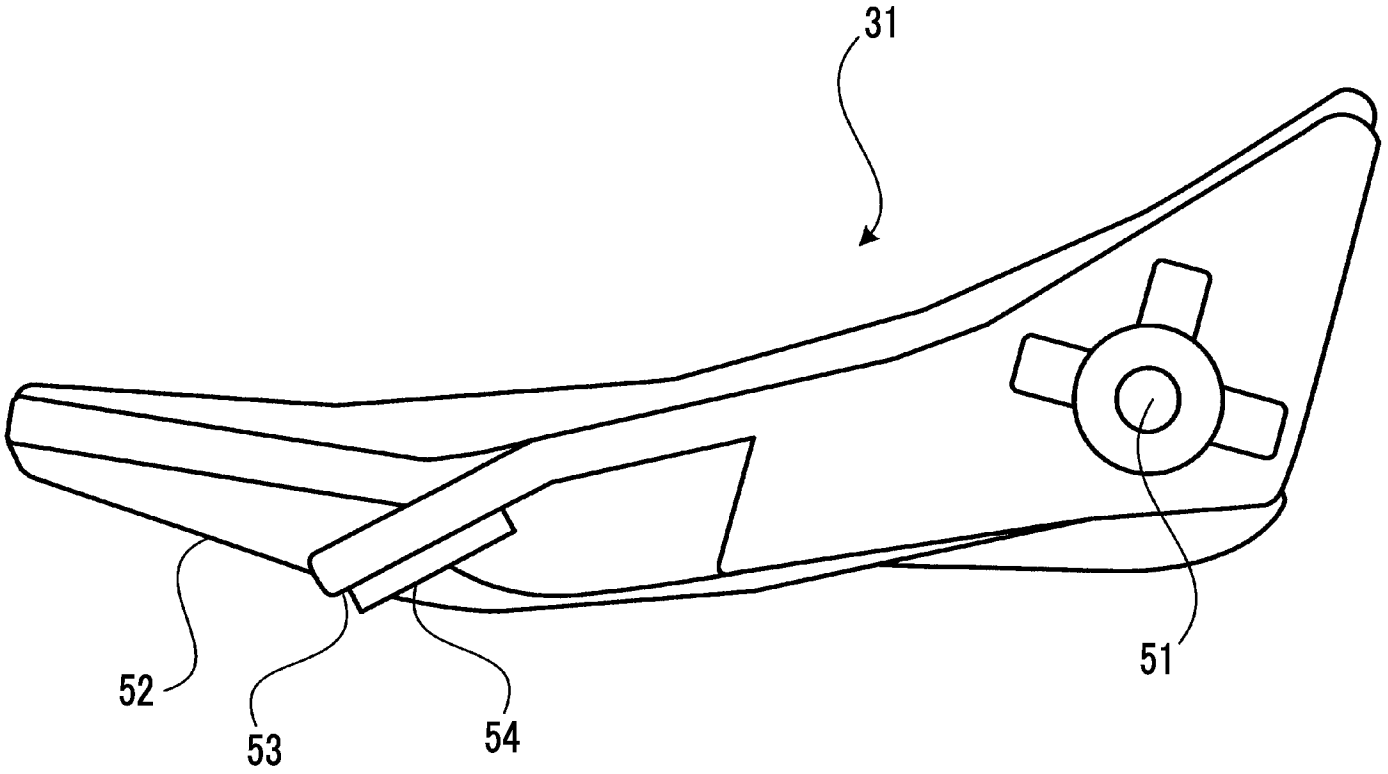
FIG. 10 is a side view of the gate member 31.

First, a perspective view of the gate member 31 in the post-processing apparatus 20 of the present exemplary embodiment is shown in FIG. 9. A side view of the gate member 31 is shown in FIG. 10.

The gate member 31 is made of a resin having a ribbed structure reinforced by plural ribs. The tip part of the gate member 31 is configured to have a curved surface that guides the sheet that has been transported, toward the upper side in the vertical direction. As shown in FIG. 10, the gate member 31 is rotatably attached about a rotation shaft 51. The gate member 31 is provided with two contact surfaces 52 and 53 that come into contact with the gate member 32. The contact surface 52 is a contact surface that comes into contact with the gate member 32 in a state in which the gate member 31 is switched to the lower position. The contact surface 53 is a contact surface that comes into contact with the gate member 32 in a state in which the gate member 31 is switched to the upper position.

The contact surface 53 is provided with a urethane cushion material 54 for silencing the sound in a case of coming into contact with the contact surface of the gate member 32.

Figure 11:
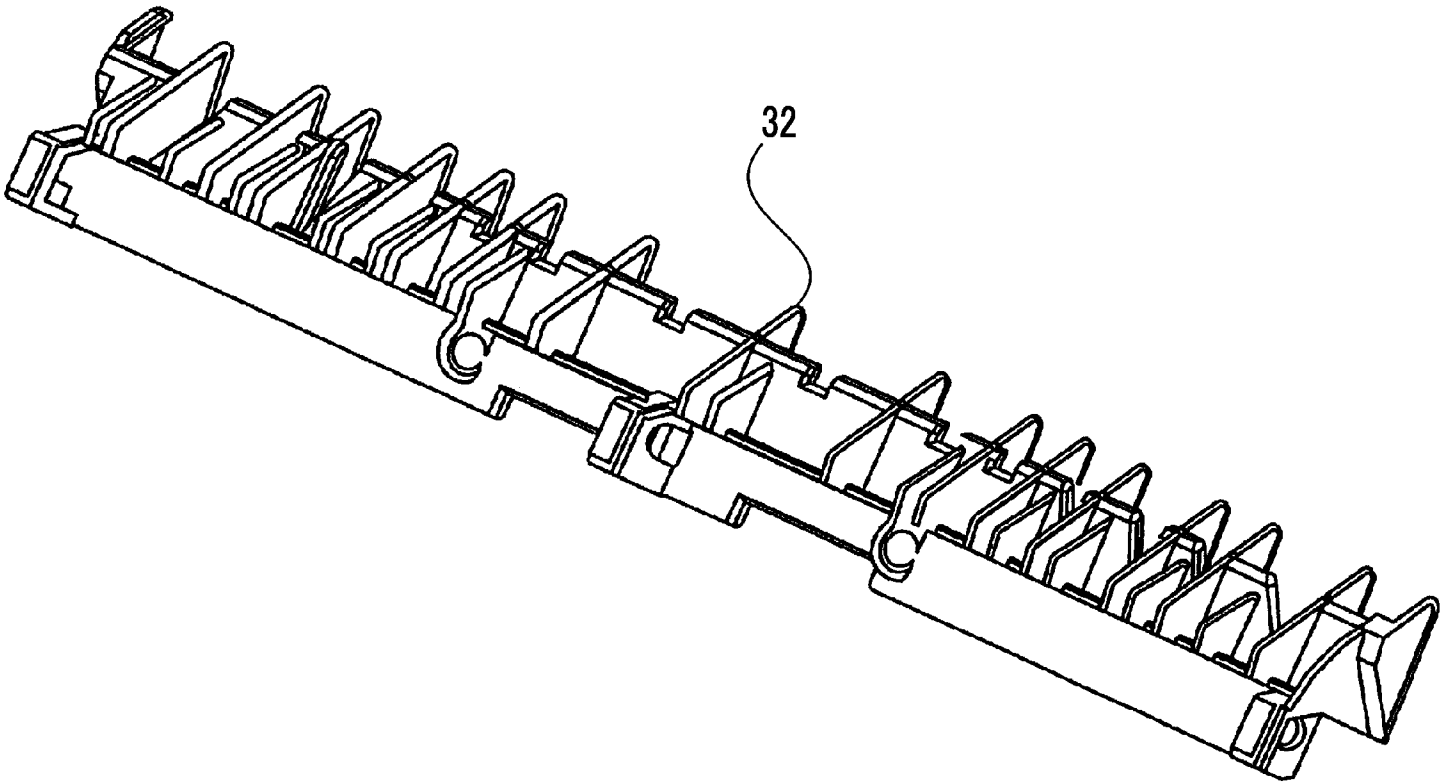
FIG. 11 is a perspective view of the gate member 32.
Figure 12:
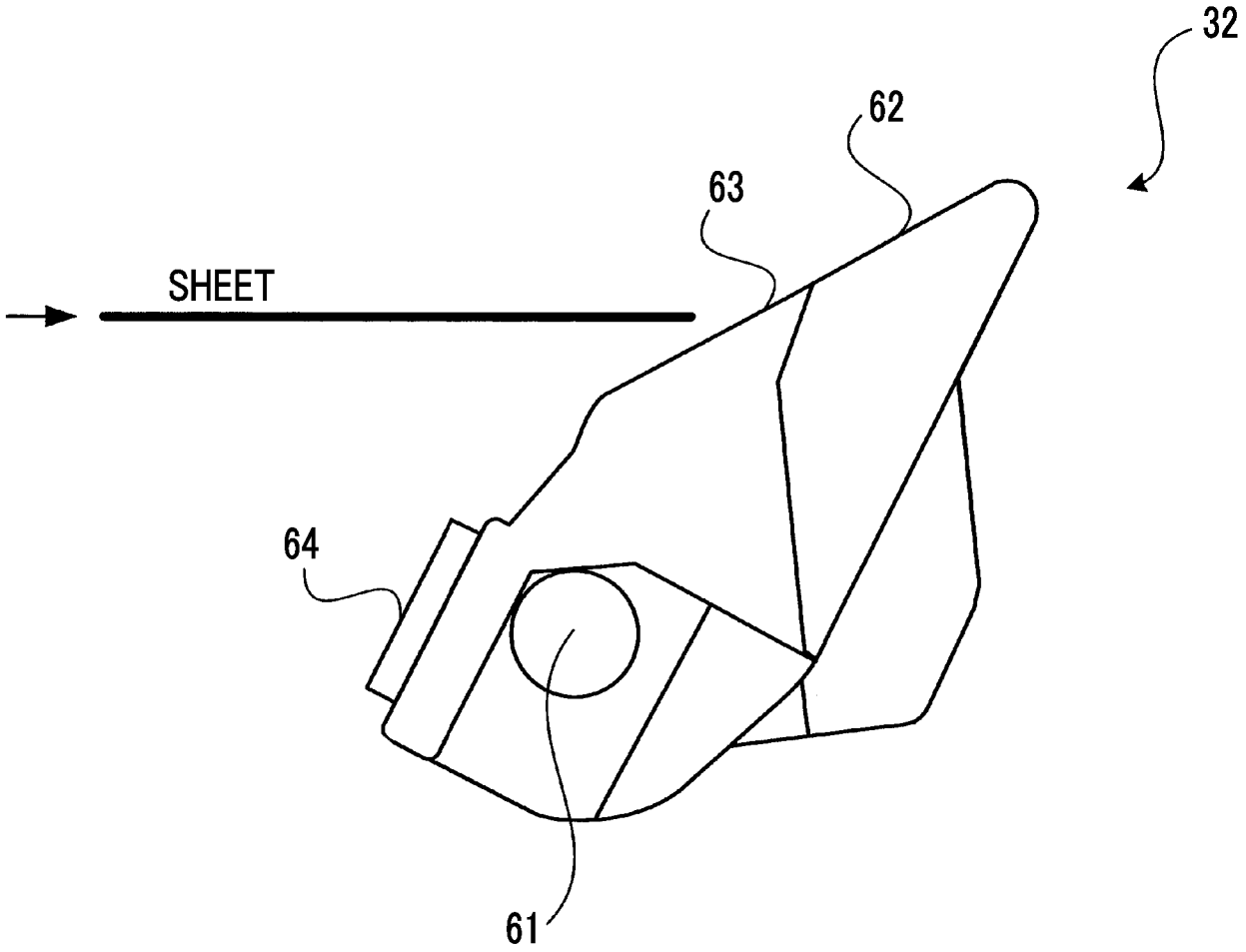
FIG. 12 is a side view of the gate member 32.

Next, a perspective view of the gate member 32 in the post-processing apparatus 20 of the present exemplary embodiment is shown in FIG. 11. A side view of the gate member 32 is shown in FIG. 12.

Like the gate member 31, the gate member 32 is also made of a resin having a ribbed structure reinforced by plural ribs. Then, as shown in FIG. 12, the gate member 32 is rotatably attached about a rotation shaft 61. The gate member 32 is provided with a contact surface 62 for contact with the gate member 31. Furthermore, the gate member 32 has a plane portion 63 that comes into contact with the sheet that has been transported. In a case where the sheet that has been transported from the left side of the figure comes into contact with the plane portion 63 and the transportation pressure is applied to the gate member 32, the gate member 32 rotates clockwise. Then, in a case where the sheet has been transported in the reverse direction from the right side of the figure, the sheet is guided in a direction along the surface of the gate member 32. The gate member 32 is also provided with a urethane cushion material 64 for silencing the sound in a case of coming into contact with another member.

Figure 13:
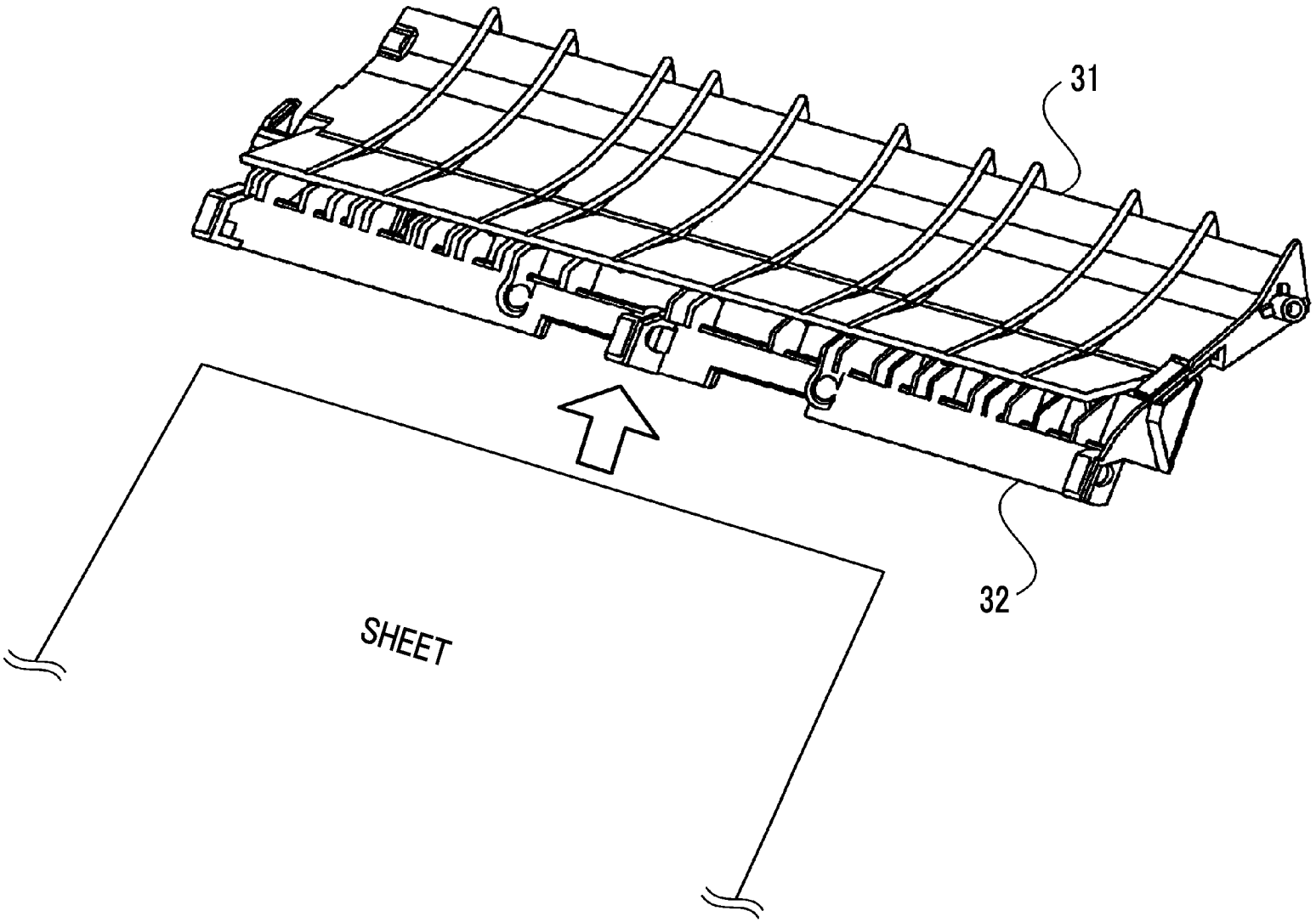
FIG. 13 is a diagram showing a positional relationship between the gate member 31 and the gate member 32.

The positional relationship between the gate member 31 and the gate member 32 described above is shown in FIG. 13. In addition, in FIG. 13, other structures existing in the periphery are omitted to facilitate understanding of the positional relationship between the gate member 31 and the gate member 32. Referring to FIG. 13, it can be seen that the gate member 31 is arranged so as to cover the upper side of the gate member 32. Then, in FIG. 13, a form in which the gate member 31 is in a state of being moved in the upward direction and the sheet that has been transported from the image forming apparatus 10 passes between the gate member 31 and the gate member 32.

Due to the structure as described above, the gate member 31 guides the sheet that has been transported from the upstream side of the transport passage to be switched to the transport direction toward the discharge tray 21.

In addition, the gate member 32 is biased by the spring 42 in the direction in which the gate member 31 is provided, and is pressed downward by the gate member 31 in a state in which the gate member 31 guides the sheet in the transport direction toward the discharge tray 21. In a state where the gate member 31 does not guide the sheet in the transport direction toward the discharge tray 21, the gate member 32 is located in a state in which the transport passage is blocked by the biasing force of the spring 42, and is pressed downward by the transportation pressure of the sheet that has been transported to pass and guide the sheet that has been transported, in the transport direction toward the finisher tray 22. Furthermore, the gate member 32 guides the sheet that has been transported in the reverse direction to the transport direction toward the finisher tray 22, in the transport direction toward the middle binding unit 26.

In order to transport the sheet in the transport direction toward the discharge tray 21, the control unit 40 controls the solenoid 41 to be switched so as to cause the gate member 31 to be located to guide the sheet in the transport direction toward the discharge tray 21. In addition, in order to transport the sheet in the transport direction toward the finisher tray 22, the control unit 40 controls the solenoid 41 to be switched so as not to cause the gate member 31 to be located to guide the sheet in the transport direction toward the discharge tray 21. In addition, in order to transport the sheet in the transport direction toward the middle binding unit 26, the control unit 40 controls the transport roll 28 to be reversed after the trailing edge of the sheet passes through the gate member 32.

In the post-processing apparatus 20 of the present exemplary embodiment, the transport direction of the sheet that has been transported is switched between the three directions by only one switching mechanism 27. Therefore, a reduction in the size of the post-processing apparatus 20 of the present exemplary embodiment can be achieved compared to a case where two or more switching mechanisms are provided at different locations and the transport directions are switched to three transport directions.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing apparatus comprising:

a transport passage on which a sheet that has been sequentially transported from an upstream side is transported;

a first transport path on which the sheet that has been transported from the transport passage is transported in a first direction;

a second transport path on which the sheet that has been transported from the transport passage is transported in a second direction;

a third transport path on which the sheet that has been transported from the transport passage is transported in a third direction; and a guide mechanism that guides the sheet that has been transported from the transport passage, to any of the first, second, and third transport paths, wherein the guide mechanism is configured by one switching mechanism, wherein the one switching mechanism has a first gate member and a second gate member which are driven by one solenoid, wherein a rotation axis of the second gate member is disposed at the upstream side with respect to a rotation axis of the first gate member, wherein the first gate member is rotatably attached about a first rotation shaft, and is switched between an upper position and a lower position in a vertical direction according to an on/off state of the one solenoid, wherein the first gate member comprises:

a first contact surface, coming into contact with the second gate member in a state in which the first gate member is switched to the lower position, and;

a second contact surface, coming into contact with the second gate member in a state in which the first gate member is switched to the upper position.

2. The post-processing apparatus according to claim 1, wherein the switching mechanism has the first gate member, a driving member that operates the first gate member, and the second gate member that operates in conjunction with the first gate member.

3. The post-processing apparatus according to claim 2, wherein the second gate member has a plane portion that is biased by an elastic member in a direction in which the first gate member is provided, and is pressed downward by being brought into contact with the sheet that has been transported from the transport passage to pass the sheet.

4. The post-processing apparatus according to claim 3, wherein a biasing force that biases the second gate member in the direction in which the first gate member is provided is set to be less than or equal to a force at which the second gate member is pressed downward by a transportation pressure in a case where the sheet that has been transported from the transport passage comes into contact with the plane portion and be more than or equal to a force at which the second gate member is able to be lifted to a position where the second gate member comes into contact with the first gate member.

5. The post-processing apparatus according to claim 2, wherein the second gate member is provided with a contact surface for contact with the first gate member.

6. The post-processing apparatus according to claim 5, wherein a contact surface of the first gate member for contact with the second gate member is provided with a silencing member for silencing a sound in a case of coming into contact with the contact surface of the second gate member.

* * * * *